US006213860B1

(12) United States Patent
Tunstall et al.

(10) Patent No.: US 6,213,860 B1
(45) Date of Patent: Apr. 10, 2001

(54) GRINDING WHEEL

(75) Inventors: John Tunstall, Buffalo Grove; George Laskaris, Niles, both of IL (US)

(73) Assignee: Unicorn Abrasives Limited, Stafford (GB)

( * ) Notice: Subject to any disclaimer, the term of this patent is extended or adjusted under 35 U.S.C. 154(b) by 0 days.

(21) Appl. No.: 09/601,433

(22) PCT Filed: Feb. 4, 1999

(86) PCT No.: PCT/GB99/00358

§ 371 Date: Sep. 21, 2000

§ 102(e) Date: Sep. 21, 2000

(87) PCT Pub. No.: WO99/39875

PCT Pub. Date: Aug. 12, 1999

Related U.S. Application Data

(63) Continuation of application No. 09/018,804, filed on Feb. 4, 1998.

(51) Int. Cl.[7] ..... B24B 1/04

(52) U.S. Cl. ..... 451/541; 451/544; 451/547; 125/15; 51/295

(58) Field of Search ..... 451/541, 540, 451/542, 544, 546, 547; 51/295; 125/15

(56) References Cited

U.S. PATENT DOCUMENTS

| | | | | |
|---|---|---|---|---|
| 3,201,902 | * | 8/1965 | Benson et al. | 451/541 |
| 3,640,027 | * | 2/1972 | Weiss | 451/541 |
| 4,523,930 | * | 6/1985 | Williston . | |
| 4,677,963 | * | 7/1987 | Ajamian | 451/541 |
| 5,079,875 | * | 1/1992 | Unno et al. | 451/541 |
| 5,495,844 | * | 3/1996 | Kitajima et al. | 451/541 |
| 5,645,476 | * | 7/1997 | Meyer . | |
| 5,725,416 | * | 3/1998 | Russell | 451/541 |

FOREIGN PATENT DOCUMENTS

| | | | |
|---|---|---|---|
| 523260 | * | 1/1993 | (EP) . |
| 2-116475 | * | 5/1990 | (JP) . |

* cited by examiner

*Primary Examiner*—Eileen P. Morgan
(74) *Attorney, Agent, or Firm*—Caesar, Rivise, Bernstein, Cohen & Pokotilow, Ltd.

(57) ABSTRACT

A grinding wheel for use in grinding glass, has an outer periphery of abrasive material secured to a body portion made of a lightweight material.

8 Claims, 1 Drawing Sheet

GRINDING WHEEL

This is a continuation of U.S. application Ser. No. 09/018,804, filed Feb. 4, 1998 pending.

This invention relates to a grinding wheel and to a method of making a grinding wheel. It is particularly intended to provide a grinding wheel that is lighter in weight than corresponding wheels of conventional construction, such as comprise an abrasive outer rim portion.

Accordingly, it is an object of the invention to provide an improved grinding wheel of lighter weight whereby advantages such as more efficient power usage and lower torque exerted on the motors used to drive the wheel may be realised. Such benefits are of particular value in the grinding of glass, e.g. automotive glass.

According to the invention in one aspect there is provided a grinding wheel comprising an annular body portion having an inner periphery which is attached to an annular wheel centre and an outer periphery which is attached to an outer circumferential layer of abrasive material, the body portion having been cast about and thereby secured to the outer periphery and the inner periphery, the cast body portion having a low density.

In a second aspect the invention provides a method of making a grinding wheel in which a ring of abrasive material is positioned in a mould, the ring surrounding and being spaced from an annular wheel centre which is also positioned in the mould, whereby an annular gap is formed in the mould, and a lightweight material is cast into the mould to fill the annular gap and to bond to the ring of abrasive material and to the annular wheel centre.

The ring of abrasive material is preferably comprised of a bonded diamond composition, e.g. an impregnated metal, resin or vitreous composition containing the abrasive diamond. Preferably it is made as a complete insert ring, or it may be as a series of segments which form a ring. The ring is made by any convenient means, e.g. a conventional technique such as pressure sintering or cold pressing and sintering.

The ring is preferably formed with a dovetail or other undercut cross-section or otherwise shaped cross-section to assist its bonding or keying to the cast body portion.

The lightweight cast body portion is formed of a low density material, e.g. a plastics such as polyurethane or epoxy resin; aluminium or an aluminium alloy, and preferably has a density in its final condition of less than about 4 g/cc.

In a particularly preferred embodiment the lightweight cast body portion is formed by die-casting.

The annular wheel centre may be any conventional wheel centre, e.g. of metal, and having a channel-shaped outer perimeter to receive and bond to the cast body portion, with a central hole to receive a spindle to drive the grinding wheel.

The lightweight wheels of the invention have a number of advantages over conventional wheels. This is particularly notable when grinding glass. As indicated above, wheels of the invention exert lower torque on driving motors during use and they incur less power loss due to the weight of the wheel leaving more power available for grinding. Alternatively, lower power consumption can lead to improved grinding speed with a reduced need for abrasive dressing. The wheel may have improved corrosion protection in aqueous environments and cause less vibration leading to better surface finish. Wheel life may be improved.

Embodiments of the invention will now be described by way of example only with reference to the accompanying drawings in which.

Figure 1:
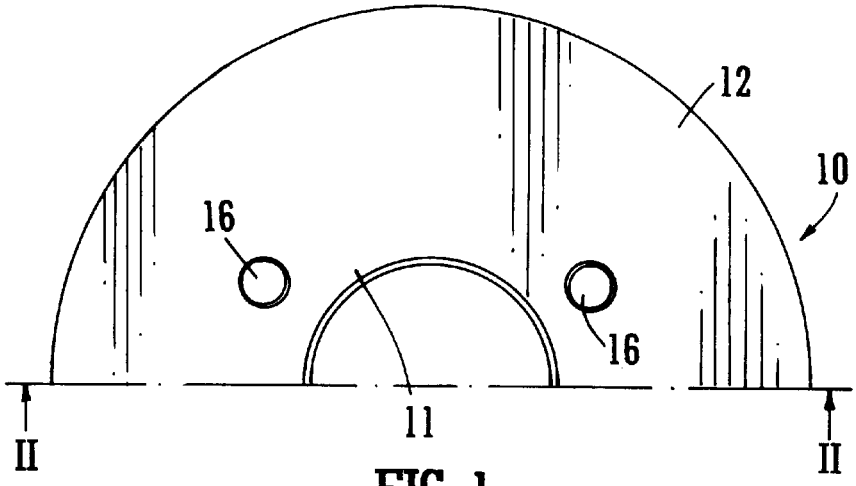
FIG. 1 is a plan view of a portion of a grinding wheel according to the invention.
Figure 2:
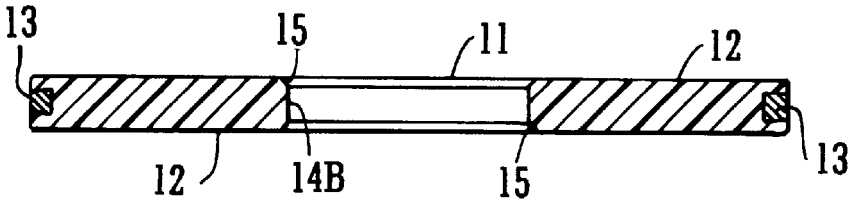
FIG. 2 is a cross-section along line II—II of FIG. 1.
Figure 3:
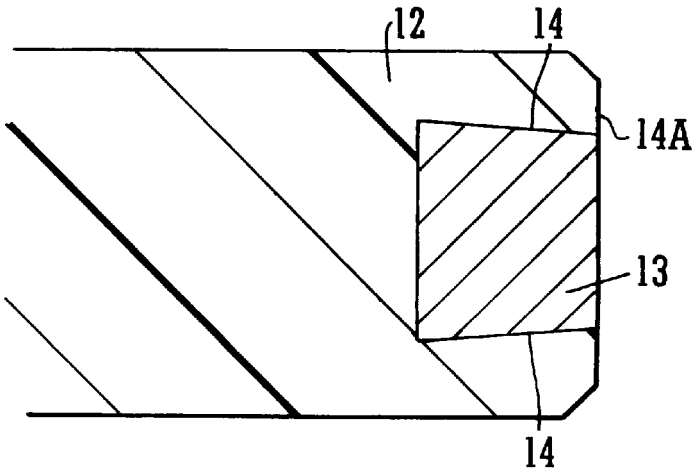
FIG. 3 is an enlarged view of a portion of the section of FIG. 2.

In the drawings grinding wheel 10 has an annular wheel centre 11, a lightweight die-cast aluminium body portion 12 and an abrasive outer circumferential layer 13. The abrasive outer circumferential layer 13, which forms the abrasive outer rim of the wheel, is of trapezoidal or dovetail shape so as to be firmly keyed into a corresponding hollow annular groove 14 in the outer periphery 14A of the cast body portion 12. The annular groove 14 is of course formed in-situ when the body portion is cast against the circumferential layer 13 after the latter has been positioned in a suitable mould.

A similar dovetail connection is made between the inner periphery 14B of body portion 12 and wheel 11, which has sloping shoulders 15 to receive the inner periphery as it is cast in the mould.

As is conventional, the body portion 12 may include a series of equi-spaced holes 16, drilled or cast in-situ for attachment/location purposes.

Wheels of the invention may be found particularly useful as superabrasive wheels for glass edging but it will be appreciated that the invention is not limited thereto.

In the example, the body is die cast of aluminium; it may however be cast of resin or other lightweight material, including composite.

What is claimed is:

1. A method of making a lightweight grinding wheel, the method comprising placing a ring of abrasive material in a mold, and positioning an annular wheel center in the mold spaced from the ring, and casting aluminum or aluminum alloy into the annular gap between the ring and the wheel center to bond the ring and wheel together and thereby form a wheel having a body with a density of less than 4 g/cc.

2. A method according to claim 1, in which the lightweight cast body portion is formed by die-casting.

3. A method according to claim 1, in which the ring of abrasive material is positioned in the mold as a series of segments.

4. A grinding wheel comprising an annular body portion having an inner periphery which is attached to an annular wheel center and an outer periphery which is attached to an outer circumferential layer of abrasive material, wherein the body portion has been cast and thereby secured to the inner periphery and the outer periphery and is made of aluminum or aluminum alloy which has a density of less than 4 g/cc.

5. A grinding wheel according to claim 4 in which the circumferential layer is a series of segments.

6. A grinding wheel according to claim 5 in which the circumferential layer of abrasive material has a dovetail or undercut cross-section.

7. A method according to claim 4, in which the ring of abrasive material is made by pressure sintering.

8. A method according to claim 4, in which the ring of abrasive material is made by cold pressing and sintering.

* * * * *